US008223029B2

(12) United States Patent
Chung et al.

(10) Patent No.: US 8,223,029 B2
(45) Date of Patent: Jul. 17, 2012

(54) METHOD FOR CONTROLLING CLEANING DEVICE

(75) Inventors: Yu-Liang Chung, Taipei (TW); Chun-Hsien Liu, Taipei (TW); Chun-Chieh Wang, Taipei County (TW); Long-Der Chen, Hsinchu (TW); Chen Meng-Chun, Tainan County (TW); Chun-Sheng Wang, Nantou County (TW)

(73) Assignee: Industrial Technology Research Institute, Hsinchu (TW)

( * ) Notice: Subject to any disclaimer, the term of this patent is extended or adjusted under 35 U.S.C. 154(b) by 367 days.

(21) Appl. No.: 12/649,152

(22) Filed: Dec. 29, 2009

(65) Prior Publication Data

US 2011/0115638 A1 May 19, 2011

(30) Foreign Application Priority Data

Nov. 16, 2009 (TW) ..... 98138838 A

(51) Int. Cl.
*G08B 21/00* (2006.01)
*G08B 23/00* (2006.01)

(52) U.S. Cl. ..... 340/635; 340/636.11; 340/693.6

(58) Field of Classification Search ..... None
See application file for complete search history.

(56) References Cited

U.S. PATENT DOCUMENTS 4,399,585 A * 8/1983 Kullik et al. ..... 15/319
4,680,827 A * 7/1987 Hummel ..... 15/319
5,152,028 A * 10/1992 Hirano ..... 15/319
5,163,202 A * 11/1992 Kawakami et al. ..... 15/319
5,182,833 A * 2/1993 Yamaguchi et al. ..... 15/319
5,427,596 A * 6/1995 Jorgenson et al. ..... 96/399
5,542,146 A * 8/1996 Hoekstra et al. ..... 15/319
5,874,683 A * 2/1999 Lee et al. ..... 73/865.9
5,918,344 A * 7/1999 Crevling et al. ..... 15/339
6,313,597 B1 * 11/2001 Elliott et al. ..... 318/701
7,599,758 B2 * 10/2009 Reindle et al. ..... 700/258
2002/0075615 A1 * 6/2002 Miermans ..... 361/78
2005/0160556 A1 * 7/2005 Hitzelberger et al. ..... 15/389
2007/0221198 A1 * 9/2007 Yi ..... 126/299 R
2008/0034532 A1 * 2/2008 Yang ..... 15/319
2009/0119867 A1 * 5/2009 Senoo et al. ..... 15/319

* cited by examiner

*Primary Examiner* — Daniel Wu
*Assistant Examiner* — Emily C Terrell
(74) *Attorney, Agent, or Firm* — Morris Manning & Martin LLP; Tim Tingkang Xia, Esq.

(57) ABSTRACT

A method for controlling a cleaning device is presented, which includes the following steps. A cleaning device includes a control unit, a fan module, an optical emitter, and an optical sensor. The optical emitter and the optical sensor are located in an air inlet of the fan module. The control unit is preset with a first impedance value (Z1), a second impedance value (Z2), and a threshold, where 0<Z1<Z2. Then, the control unit reads an impedance value (Z) of the fan module. If Z1<Z<Z2, the control unit drives the fan module. If Z2<Z, the control unit reads a detected value of the optical sensor. If the detected value exceeds the threshold, the control unit drives the fan module, so as to increase a suction force of the fan module. If the detected value is smaller than the threshold, the control unit turns off the fan module.

8 Claims, 4 Drawing Sheets

METHOD FOR CONTROLLING CLEANING DEVICE

CROSS-REFERENCE TO RELATED APPLICATIONS

This non-provisional application claims priority under 35 U.S.C. §119(a) on Patent Application No(s). 098138838 filed in Taiwan, R.O.C. on Nov. 16, 2009, the entire contents of which are hereby incorporated by reference.

BACKGROUND OF THE INVENTION

1. Field of the Invention

The present invention relates to a method for controlling a cleaning device, and more particularly to a method for controlling a vacuum cleaner.

2. Related Art

Particle (dust) detecting technologies have been applied to particle amount detection and environment control of conventional vacuum cleaners, air cleaners, and self-propelled vacuum cleaners, so as to clean up the particles (dust) more effectively. Therefore, as long as the amount of particles (dust) can be detected in a simple but effective manner, such a technology may be used to enhance the service efficiency of the conventional vacuum cleaner, the air cleaner, and the self-propelled vacuum cleaner, thereby achieving the effect of energy saving and carbon reduction.

The existing particle detecting technologies may be roughly divided into the following three types.

(1) Optical detecting type: in the particle detecting technology of this type, the content of particles (dust) in the air is detected by using a pair of optical emitting and receiving devices. When the content of particles (dust) in the air rises, the light flux detected by the receiving device is lowered with the increase of the content of particles (dust). Therefore, such a technology can determine the content of particles (dust) in the air through the light flux detected by the receiving device.

(2) Pressure difference detecting type: in the particle detecting technology of this type, the content of particles (dust) in the conventional vacuum cleaner, the air cleaner, and the self-propelled vacuum cleaner is determined through the pressure difference between the air inlet and the air outlet of the conventional vacuum cleaner, the air cleaner, or the self-propelled vacuum cleaner.

(3) Piezoelectric pressure sensing type: in the particle detecting technology of this type, a pressure sensing element fabricated by using lead zirconate titanate (PZT) is placed on a wall of the air inlet. Therefore, when the particles (dust) in the air are sucked into the air inlet of the conventional vacuum cleaner, the air cleaner, or the self-propelled vacuum cleaner, such a technology can determine the amount of garbage in the air inlet through the force of impacting the pressure sensing element by the particles (dust).

Although various particle detecting technologies are proposed in the prior art, the conventional vacuum cleaner, the air cleaner, or the self-propelled vacuum cleaner still cannot automatically recognize the states that a mechanical failure occurs, the filter screen is broken, the dust collection box is full, the amount of dust is increased, and the like.

SUMMARY OF THE INVENTION

In order to solve the above problem, the present invention is a method for controlling a cleaning device, so as to automatically recognize the states that the dust collection box is full, the amount of dust is increased, the cleaning device is in a normal state, and the like.

Therefore, in an embodiment, the present invention provides a method for controlling a cleaning device, which comprises the following steps. A cleaning device, comprising a control unit, a fan module, an optical emitter, and an optical sensor, is provided. The fan module and the optical sensor are respectively electrically connected to the control unit. The optical emitter and the optical sensor are located in an air inlet of the fan module, and the optical sensor receives a light ray emitted by the optical emitter. The control unit is preset with a first impedance value (Z1), a second impedance value (Z2), and a threshold, where $0<Z1<Z2$. Then, the control unit reads an impedance value (Z) of the fan module, and compares the impedance value with the first impedance value and the second impedance value. If $Z1<Z<Z2$, the control unit drives the fan module to generate a first pressure difference. If $Z2<Z$, the control unit reads an intensity of the received light ray detected by the optical sensor. If the light ray intensity exceeds the threshold, the control unit drives the fan module to generate a second pressure difference, and the second pressure difference is greater than the first pressure difference. If the light ray intensity is smaller than the threshold, the control unit turns off the fan module.

In other embodiments of the present invention, if $Z<Z1$, the control unit turns off the fan module.

Moreover, in another embodiment, the present invention further provides a method for controlling a cleaning device, which comprises the following steps. A cleaning device, comprising a control unit, a fan module, an optical emitter, and an optical sensor, is provided. The fan module and the optical sensor are respectively electrically connected to the control unit. The optical emitter and the optical sensor are located in an air inlet of the fan module. The optical sensor receives a light ray emitted by the optical emitter, and detects an intensity of the received light ray. The control unit is preset with a first impedance value (Z1), a second impedance value (Z2), a third impedance value (Z3), and a threshold, where $0<Z1<Z2<Z3$. Then, the control unit reads an impedance value (Z) of the fan module, and compares the impedance value with the first impedance value, the second impedance value, and the third impedance value. If $Z1<Z<Z2$, the control unit drives the fan module to generate a first pressure difference. If $Z2<Z<Z3$, the control unit reads the intensity of the received light ray detected by the optical sensor. If the light ray intensity exceeds the threshold, the control unit drives the fan module to generate a second pressure difference, and the second pressure difference is greater than the first pressure difference. If the light ray intensity is smaller than the threshold, the control unit turns off the fan module. If $Z3<Z$, the control unit turns off the fan module.

In other embodiments of the present invention, the control unit is preset with a fourth impedance value (Z4), where $0<Z4<Z1<Z2<Z3$, and the method further comprises: turning off the fan module by the control unit, if $Z<Z4$, and preferably emitting a warning signal by the control unit, if $Z4<Z<Z1$, in which the warning signal is, for example, a sound or a light ray.

In other embodiments of the present invention, the fan module comprises a current detection device, a motor, and a fan. The fan is connected to the motor, and the current detection device is electrically connected to the motor and the control unit. The step of reading the impedance value (Z) of the fan module by the control unit further comprises: detecting a current value of the motor by the current detection device and transmitting the current value to the control unit;

and then, converting the current value to the impedance value of the motor by the control unit.

In view of the above, in the aforementioned embodiments, the control unit determines a change of the impedance value of the fan module, and automatically increases a suction force of the fan module or turns off the fan module according to the change of the impedance value of the fan module, thereby greatly improving the use convenience. Moreover, the control unit detects an output signal of the optical sensor, such that the control unit is enabled to turn off the fan module in a state that the dust collection box is full, so as to prevent the fan module from continuously operating in this state to result in energy waste.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1A:
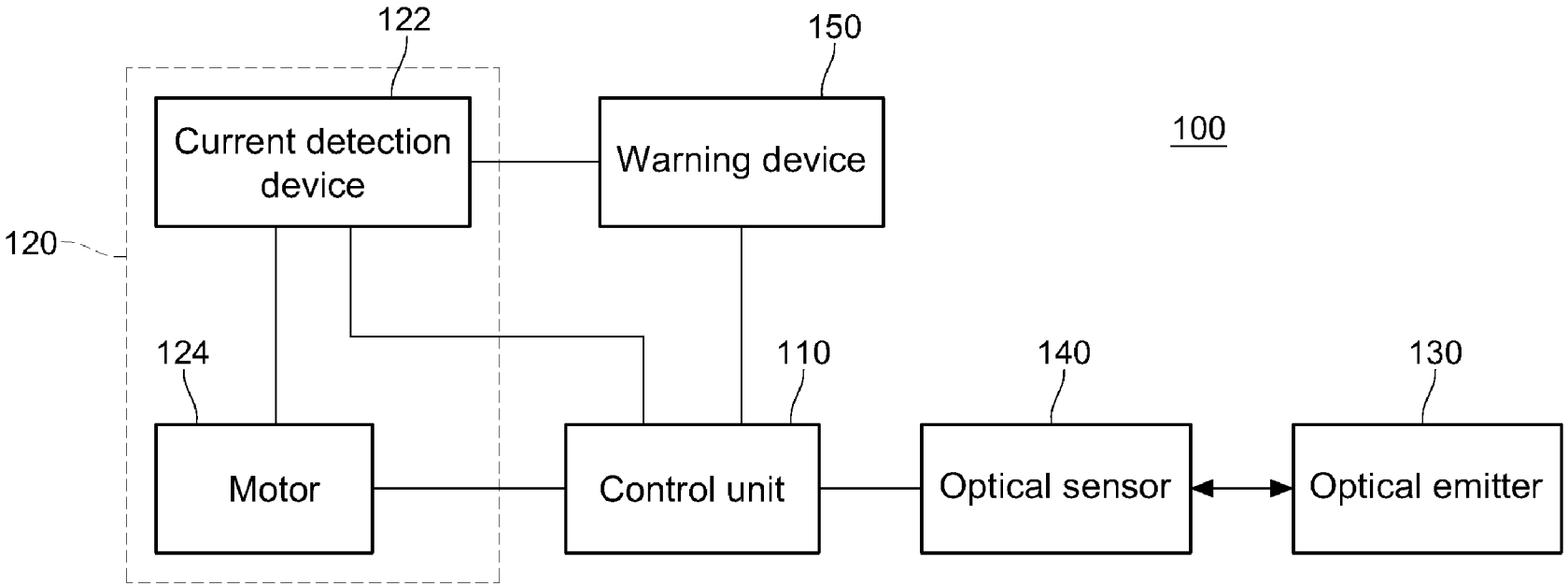
FIG. 1A is a schematic circuit diagram of a cleaning device according to an embodiment of the present invention.

FIG. 1A is a schematic circuit diagram of a cleaning device according to an embodiment of the present invention. Referring to FIG. 1A, for ease of illustration, the cleaning device 100 of this embodiment is, for example, a vacuum cleaner. In other embodiments of the present invention, the cleaning device 100 and a method for controlling the cleaning device 100 described in the following may also be applied to an air cleaner. The cleaning device 100 comprises a control unit 110, a fan module 120, an optical emitter 130, and an optical sensor 140. In this embodiment, the control unit 110 is, for example, a logic circuit. However, in another embodiment of the present invention, the control unit 110 comprises, for example, a microprocessor and a memory. A program is stored in the memory. The microprocessor is electrically connected to the memory, such that the microprocessor executes a series of steps according to the program. In still another embodiment of the present invention, the control unit 110 is, for example, an application specific integrated circuit (ASIC). Based on the above, the control unit 110 may be programmed to execute a series of steps in the method for controlling the cleaning device 100. A first impedance value Z1 and a second impedance value Z2 are preset in the control unit 110, where $0<Z1<Z2$. In addition, a threshold P is preset in the control unit 110.

The fan module 120 is electrically connected to the control unit 110, and the control unit 110 is enabled to read an impedance value of the fan module 120. More particularly, the fan module 120 comprises a current detection device 122, a motor 124, and a fan (not shown). The fan is fixed on the motor 124, such that when the motor 124 is in an operating state, the fan module 120 generates a pressure difference between an air inlet and an air outlet, so as to suck garbage into a dust collection box of the cleaning device 100. The current detection device 122 is respectively electrically connected to the motor 124 and the control unit 110, and the current detection device 122 is used for detecting a current value of the motor 124. It should be noted that, although the current detection device 122 and the motor 124 of the fan module 120 are two independent elements in this embodiment, the configuration of the fan module 120 is not limited herein. In other embodiments of the present invention, when the motor 124 is a brushless electric motor, the current detection device 122 may also be integrated in the motor 124.

The optical emitter 130 and the optical sensor 140 are located on a wall of the air inlet of the fan module 120. In this embodiment, the optical emitter 130 is an infrared emitter. The optical emitter 130 is used for emitting a light ray (that is, an infrared ray). The optical sensor 140 is used for receiving the light ray emitted by the optical emitter 130, and outputting a signal according to an intensity of the received light ray. The optical sensor 140 is electrically connected to the control unit 110, such that the control unit 110 is enabled to determine the intensity of the light ray received by the optical sensor 140 according to the signal output by the optical sensor 140.

Figure 1B:
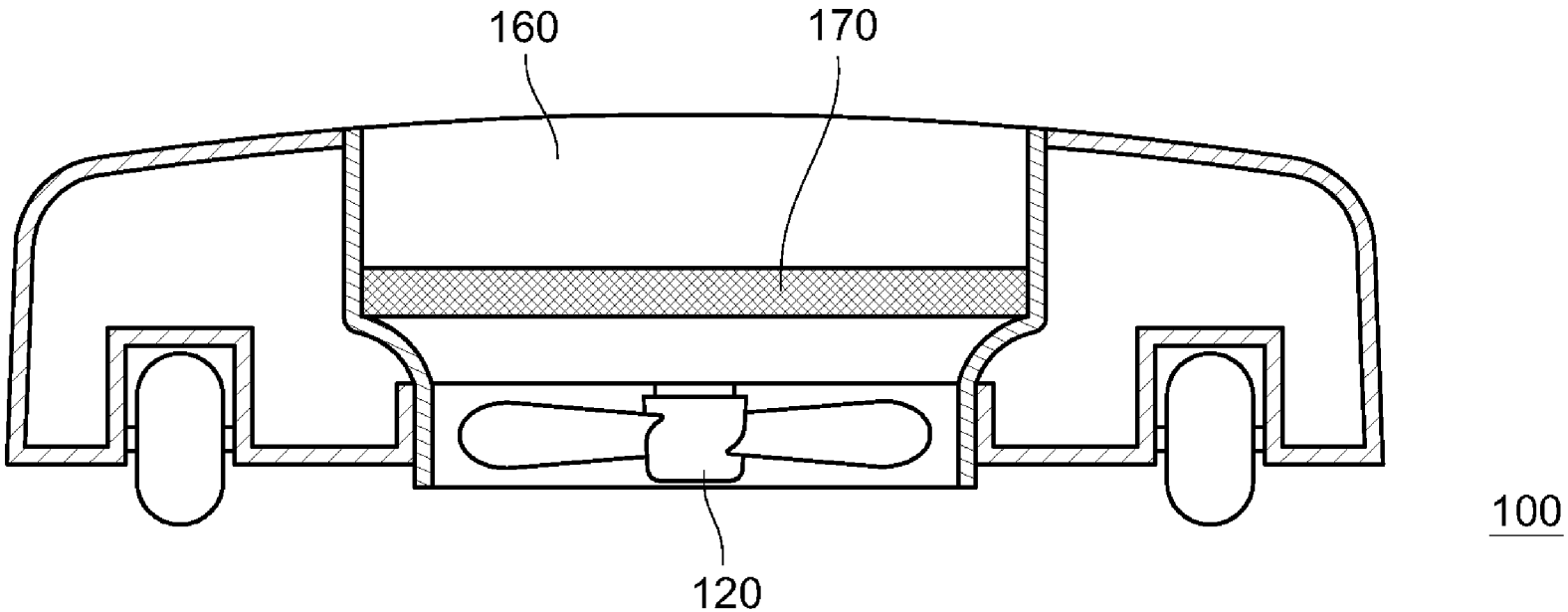
FIG. 1B is a schematic structural view of a dust collection box, a fan module, and a filter screen of a cleaning device according to an embodiment of the present invention.

FIG. 1B is a schematic structural view of the dust collection box, the fan module, and a filter screen of the cleaning device 100. Referring to FIG. 1B, since the cleaning device 100 of this embodiment is, for example, the vacuum cleaner, the cleaning device 100 further comprises a dust collection box 160 and a filter screen 170 located between the located dust collection box 160 and the fan module 120.

Figure 2:
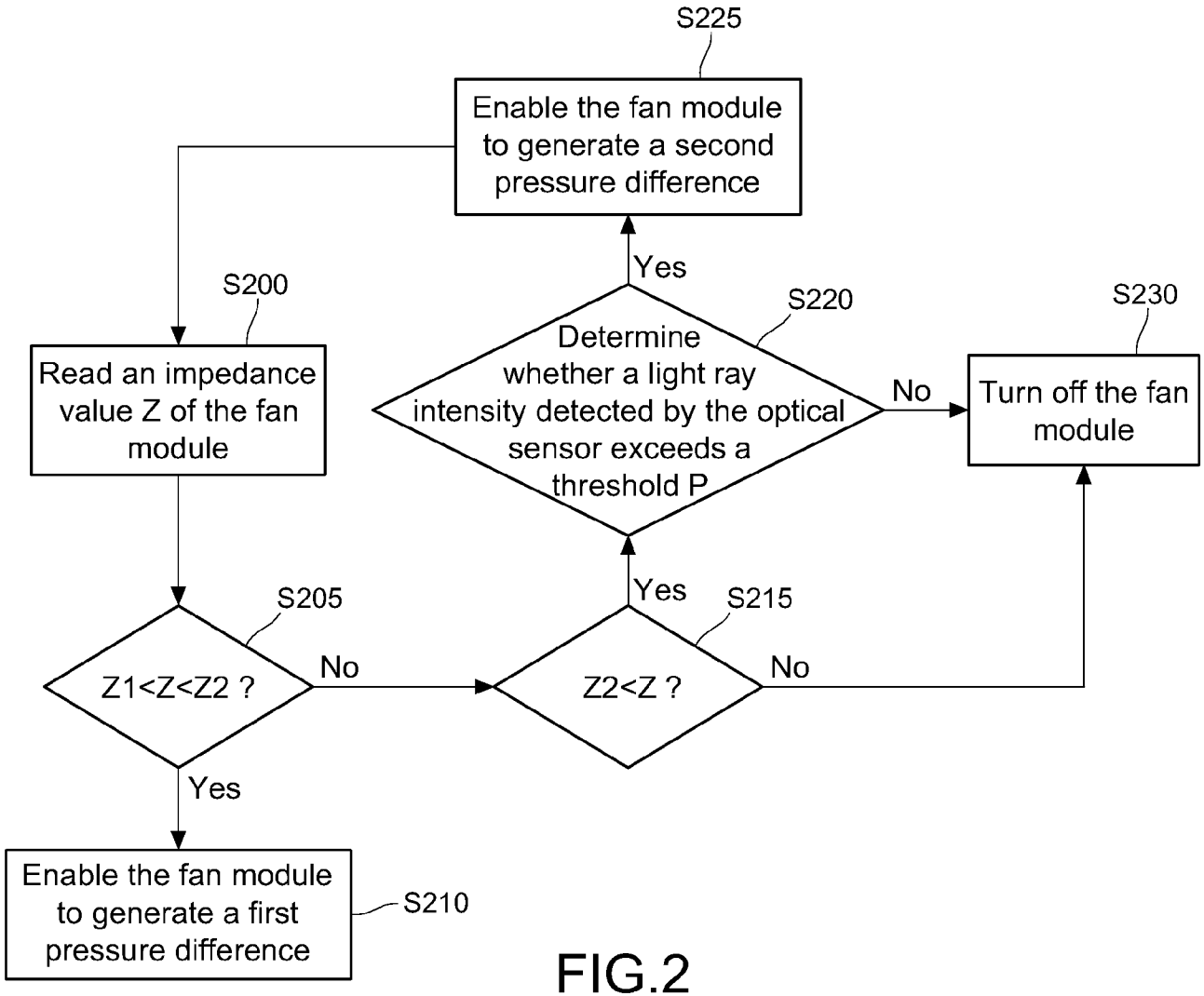
FIG. 2 shows a method for controlling a cleaning device according to an embodiment of the present invention.

Based on the above, in this embodiment, the control unit 110 executes the following steps. FIG. 2 shows the method for controlling the cleaning device according to an embodiment of the present invention. Referring to FIGS. 1A and 2, firstly, as shown in Step S200, the control unit 110 reads an impedance value Z of the fan module 120. For example, in a method of reading the fan module 120, the current detection device 122 first detects a current value of the motor 124; and then, the control unit 110 reads the current value detected by the current detection device 122, and converts the current value to the impedance value Z of the motor.

Next, as shown in Step S205, the control unit 110 respectively compares the read impedance value Z of the fan module 120 with the first impedance value Z1 and the second impedance value Z2, so as to determine whether the impedance value Z is between the first impedance value Z1 and the second impedance value Z2, that is, $Z1<Z<Z2$. If yes, it is determined that the cleaning device 100 is in the normal state, and the control unit 110 executes Step S210. In Step S210, the control unit 110 drives the fan module 120 to generate a first pressure difference. In other words, the control unit 110 drives the fan module 120 so as to enable the fan of the fan module 120 to rotate at a normal speed. It should be noted that, since the cleaning device 100 of this embodiment is, for example, the vacuum cleaner, the first pressure difference is used for sucking garbage or dust from outside the cleaning device 100 into the dust collection box of the cleaning device 100.

If the impedance value Z is not between the first impedance value Z1 and the second impedance value Z2, the control unit 110 executes Step S215. In Step S215, the control unit 110 determines whether the impedance value Z of the fan module 120 is greater than the second impedance value Z2, and if yes, the control unit 110 executes Step S220.

In Step S220, the control unit 110 reads an intensity of a light ray detected by the optical sensor 140, and determines whether the intensity of the light ray detected by the optical sensor 140 exceeds a threshold P preset in the control unit 110. In this embodiment, the optical emitter 130 and the optical sensor 140 are located on the wall of the air inlet of the fan module 120, and the optical sensor 140 is electrically connected to the control unit 110, such that the intensity of the light ray received by the optical sensor 140 is in inverse proportion to the amount of garbage between the emitter 130 and the optical sensor 140. After the optical sensor 140 receives the light ray, the optical sensor 140 converts the intensity of the received light ray to an output signal, and transmits the output signal to the control unit 110. Therefore, the control unit 110 is enabled to determine whether the intensity of the light ray detected by the optical sensor 140 is greater than the threshold P preset in the control unit 110 according to the output signal.

In Step S220, if the intensity of the light ray detected by the optical sensor 140 is greater than the threshold P preset in the control unit 110, the control unit 110 determines that the dust collection box of the cleaning device 100 is not full and the amount of garbage sucked into the cleaning device 100 in a unit time is increased. After that, the control unit 110 executes Step S225.

In Step S225, the control unit 110 controls the fan module 120 and raises the pressure difference generated by the fan module 120 from the first pressure difference to a second pressure difference, in which the second pressure difference is greater than the first pressure difference. In other words, the control unit 110 drives the fan module 120 so as to enable the fan of the fan module 120 to rotate at a speed higher than the normal rotation speed. Based on the above steps, the cleaning device 100 automatically increases the suction force in response to the increase of the amount of garbage. Next, the control unit 110 re-executes Step S200 to detect the impedance value of the fan module 120 again.

Referring to Step S220, if the intensity of the light ray detected by the optical sensor 140 is smaller than the threshold P preset in the control unit 110, the control unit 110 determines that the dust collection box of the cleaning device 100 is full. Afterward, the control unit 110 executes Step S230.

In Step 230, the dust collection box is full, and the control unit 110 turns off the fan module 120. Through Step S225, the cleaning device 100 automatically prevents the fan module 120 from continuously operating in the state that the dust collection box is full to result in energy waste.

Based on the above steps, the method for controlling the cleaning device 100 of this embodiment can automatically determine whether the cleaning device is in a normal state, or in a state that the dust collection box is full or the amount of garbage is increased, or the like, so as to adopt corresponding response measures.

In addition to the recognition of the above states, referring to Step S215, if the impedance value Z of the fan module 120 is not greater than the second impedance value Z2, the impedance value Z of the fan module 120 is smaller than the first impedance value Z1. In this case, the control unit 110 determines that the filter screen is broken, and the control unit 110 executes Step S235, that is, to turn off the fan module 120.

In addition to the method for controlling the cleaning device, according to another embodiment of the present invention, the control unit 110 is preset with four impedance values, that is, a first impedance value Z1, a second impedance value Z2, a third impedance value Z3, and a fourth impedance value Z4, where $0<Z4<Z1<Z2<Z3$. Moreover, the control unit 110 is also preset with a threshold P.

Figure 3:
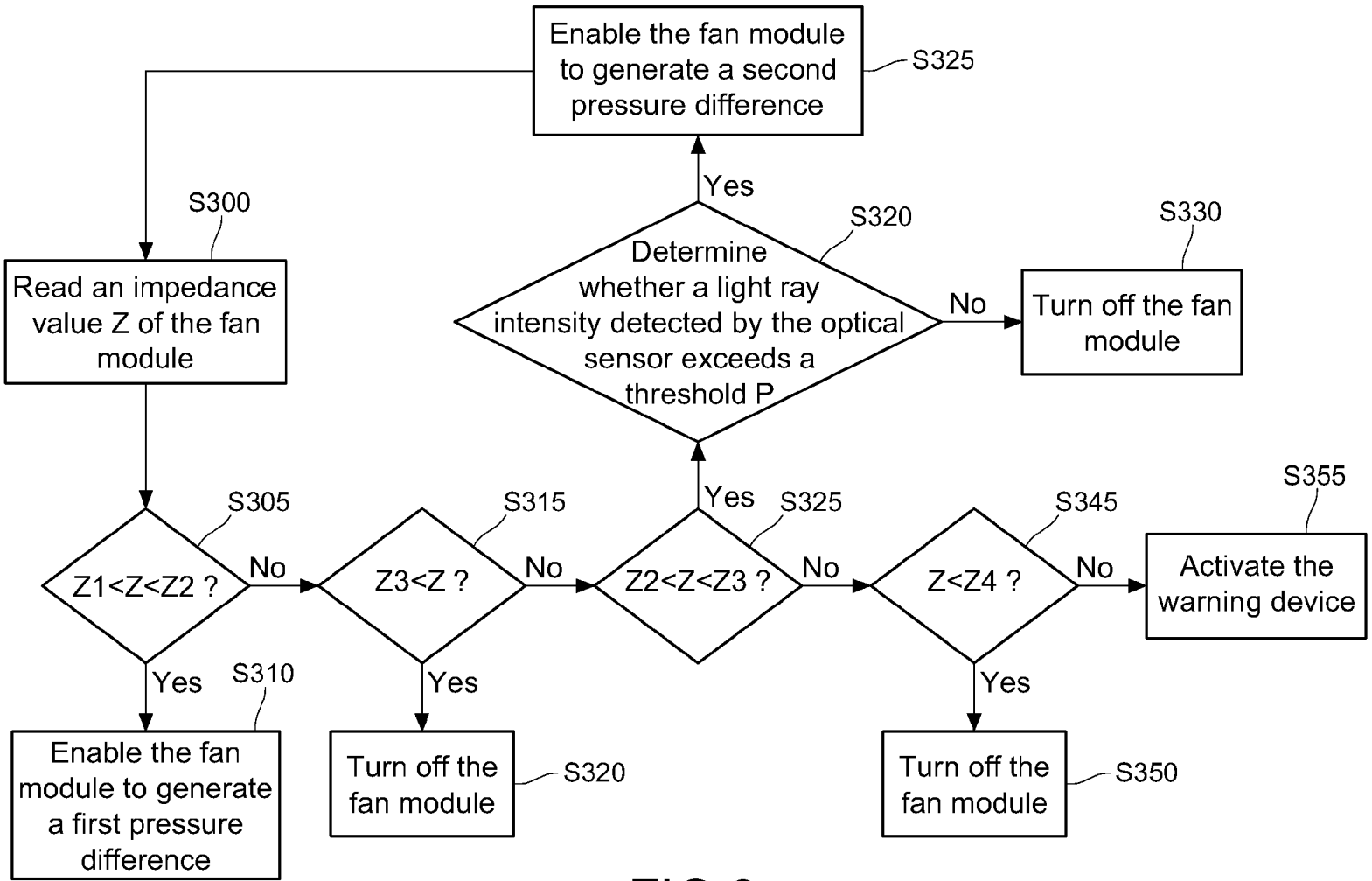
FIG. 3 shows a method for controlling a cleaning device according to another embodiment of the present invention.

Based on the above, in this embodiment, the control unit 110 executes the following steps. FIG. 3 shows the method for controlling the cleaning device according to another embodiment of the present invention. Referring to FIGS. 1A and 3, firstly, as shown in Step S300, the control unit 110 reads an impedance value Z of the fan module 120. For example, in a method of reading the fan module 120, the current detection device 122 first detects a current value of the motor 124; and then, the control unit 110 reads the current value detected by the current detection device 122, and converts the current value to the impedance value Z of the motor.

Next, as shown in Step S305, the control unit 110 respectively compares the read impedance value Z of the fan module 120 with the first impedance value Z1 and the second impedance value Z2, so as to determine whether the impedance value Z is between the first impedance value Z1 and the second impedance value Z2, that is, $Z1<Z<Z2$. If yes, it is determined that the cleaning device 100 is in the normal state, and the control unit 110 executes Step S310. In Step S310, the control unit 110 drives the fan module 120 to generate a first pressure difference. It should be noted that, since the cleaning device 100 of this embodiment is, for example, the vacuum cleaner, the first pressure difference is used for sucking garbage or dust from outside the cleaning device 100 into the dust collection box of the cleaning device 100.

Referring to Step S305, if the impedance value Z is not between the first impedance value Z1 and the second impedance value Z2, the control unit 110 executes Step 315. In Step S315, the control unit 110 determines whether the impedance value Z of the fan module 120 is greater than the third impedance value Z3. If yes, the control unit 110 determines that a mechanical failure occurs to the fan module 120, and executes Step S320. In Step S320, the control unit 110 turns off the fan module 120.

Referring to Step S315, if the control unit 110 determines that the impedance value Z of the fan module 120 is not greater than the third impedance value Z3, the control unit 110 executes Step S325. In Step S325, the control unit 110 determines whether the impedance value Z of the fan module 120 is between the second impedance value Z2 and the third impedance value Z3, that is, $Z2<Z<Z3$. If yes, the control unit 110 executes Step S320.

In Step S320, the control unit 110 reads an intensity of a light ray detected by the optical sensor 140, and determines whether the intensity of the light ray detected by the optical sensor 140 exceeds a threshold P preset in the control unit 110. In this embodiment, the optical emitter 130 and the optical sensor 140 are located on the wall of the air inlet of the fan module 120, and the optical sensor 140 is electrically connected to the control unit 110, such that the intensity of the light ray received by the optical sensor 140 is in inverse proportion to the amount of garbage between the emitter 130 and the optical sensor 140. After the optical sensor 140 receives the light ray, the optical sensor 140 converts the intensity of the received light ray to an output signal, and transmits the output signal to the control unit 110. Therefore, the control unit 110 is enabled to determine whether the intensity of the light ray detected by the optical sensor 140 is greater than the threshold P preset in the control unit 110 according to the output signal.

In Step S320, if the intensity of the light ray detected by the optical sensor 140 is greater than the threshold P preset in the control unit 110, the control unit 110 determines that the dust collection box of the cleaning device 100 is not full and the amount of garbage sucked into the cleaning device 100 in a unit time is increased. After that, the control unit 110 executes Step S325.

In Step S325, the dust collection box is not full and the amount of garbage is increased, such that the control unit 110 controls the fan module 120 and raises the pressure difference generated by the fan module 120 from the first pressure difference to a second pressure difference, in which the second pressure difference is greater than the first pressure difference. Based on the above steps, the cleaning device 100 automatically increases the suction force in response to the increase of the amount of garbage. Next, the control unit 110 re-executes Step S300 to detect the impedance value of the fan module 120 again.

Referring to Step S320, if the intensity of the light ray detected by the optical sensor 140 is smaller than the threshold P preset in the control unit 110, the control unit 110 determines that the dust collection box of the cleaning device 100 is full. Afterward, the control unit 110 executes Step S330.

In Step S330, the dust collection box is full, and the control unit 110 turns off the fan module 120. Through Step S330, the cleaning device 100 automatically prevents the fan module 120 from continuously operating in the state that the dust collection box is full to result in energy waste.

In addition to the recognition of the above states, referring to Step S325, if the impedance value Z of the fan module 120 is not between the second impedance value Z2 and the third impedance value Z3, the control unit 110 determines whether the impedance value Z of the fan module 120 is smaller than the fourth impedance value Z4 (Step S345). If yes, the control unit 110 determines that the filter screen is not installed in the cleaning device 100, and executes Step S350. In Step S350, the control unit 110 turns off the fan module 120.

Referring to Step S345, if the impedance value Z of the fan module 120 is not smaller than the fourth impedance value Z4, the impedance value Z of the fan module 120 is between the first impedance value Z1 and the fourth impedance value Z4. In this case, the control unit 110 determines that the filter screen is broken, and the control unit 110 executes Step S355. In Step S355, the control unit 110 turns off the fan module 120. Preferably, in this embodiment, as shown in FIG. 1A, the cleaning device 100 further comprises a warning device 150, and the warning device 150 is electrically connected to the control unit 110. The warning device 150 is, for example, a buzzer or an indicator. Based on the design of the warning device 150, when the impedance value Z of the fan module 120 is not smaller than the second impedance value Z2, in addition to turning off the fan module 120, the control unit 110 also activates the warning device 150, so as to remind the user to replace the filter screen by making a sound or emitting a light.

In view of the above, in the aforementioned embodiments, the control unit determines a change of the impedance value of the fan module, and automatically increases a suction force of the fan module or turns off the fan module according to the change of the impedance value of the fan module, thereby greatly improving the use convenience. Moreover, the control unit detects an output signal of the optical sensor, such that the control unit is enabled to turn off the fan module in a state that the dust collection box is full, so as to prevent the fan module from continuously operating in this state to result in energy waste.

What is claimed is:

1. A method for controlling a cleaning device, comprising:

providing a cleaning device which comprises a control unit, a fan module, an optical emitter and an optical sensor, wherein the fan module and the optical sensor are respectively electrically connected to the control unit, the optical emitter and the optical sensor are located in an air inlet of the fan module, the optical sensor receives a light ray emitted by the optical emitter and detects an intensity of the received light ray, and the control unit is preset with a first impedance value (Z1), a second impedance value (Z2) and a threshold, where $0<Z1<Z2$; and reading an impedance value (Z) of the fan module by the control unit and comparing the impedance value with the first impedance value and the second impedance value, wherein if $Z1<Z<Z2$, the control unit drives the fan module to generate a first pressure difference; and if $Z2<Z$, the control unit reads the intensity of the received light ray detected by the optical sensor, where the control unit drives the fan module to generate a second pressure difference greater than the first pressure difference if the light ray intensity exceeds the threshold, and the control unit turns off the fan module if the light ray intensity is smaller than the threshold.

2. The method for controlling the cleaning device according to claim 1, wherein if $Z<Z1$, the control unit turns off the fan module.

3. The method for controlling the cleaning device according to claim 1, wherein the fan module comprises a current detection device, a motor and a fan, the fan is connected to the motor, the current detection device is electrically connected to the motor and the control unit, and the step of reading the impedance value (Z) of the fan module by the control unit further comprises:

detecting a current value of the motor by the current detection device and transmitting the current value to the control unit; and converting the current value to the impedance value of the motor by the control unit.

4. A method for controlling a cleaning device, comprising:

providing a cleaning device which comprises a control unit, a fan module, an optical emitter and an optical sensor, wherein the fan module and the optical sensor are respectively electrically connected to the control unit, the optical emitter and the optical sensor are located in an air inlet of the fan module, the optical sensor receives a light ray emitted by the optical emitter and detects an intensity of the received light ray, and the control unit is preset with a first impedance value (Z1), a second impedance value (Z2), a third impedance value (Z3) and a threshold, where $0<Z1<Z2<Z3$; and reading an impedance value (Z) of the fan module by the control unit and comparing the impedance value with the first impedance value, the second impedance value and the third impedance value, wherein if $Z1<Z<Z2$, the control unit drives the fan module to generate a first pressure difference;

if $Z2<Z<Z3$, the control unit reads the intensity of the received light ray detected by the optical sensor, where the control unit drives the fan module to generate a second pressure difference greater than the first pressure difference if the light ray intensity exceeds the threshold, and the control unit turns off the fan module if the light ray intensity is smaller than the threshold; and if $Z3<Z$, the control unit turns off the fan module.

5. The method for controlling the cleaning device according to claim 4, wherein the control unit is preset with a fourth impedance value (Z4), where $0<Z4<Z1<Z2<Z3$, and the method further comprises: turning off the fan module by the control unit if $Z<Z4$.

6. The method for controlling the cleaning device according to claim 5, further comprising:

emitting a warning signal by the control unit if $Z4<Z<Z1$.

7. The method for controlling the cleaning device according to claim 6, wherein the warning signal is a sound or another light ray.

8. The method for controlling the cleaning device according to claim 4, wherein the fan module comprises a current detection device, a motor and a fan, the fan is connected to the motor, the current detection device is electrically connected to the motor and the control unit, and the step of reading the impedance value (Z) of the fan module by the control unit further comprises:

detecting a current value of the motor by the current detection device and transmitting the current value to the control unit; and converting the current value to the impedance value of the motor by the control unit.

* * * * *